US007161300B2

(12) United States Patent
Zeng et al.

(10) Patent No.: US 7,161,300 B2
(45) Date of Patent: Jan. 9, 2007

(54) PLASMA DISPLAY PANEL WITH TWO OPPOSING FLUORESCENT LAYERS IN VUV & UV DISCHARGE SPACE

(75) Inventors: Xiaoqing Zeng, Yongin-si (KR); Hidekazu Hatanaka, Scongnam-si (KR); Young-Mo Kim, Suwon-si (KR); Seong-Eui Lee, Seongnam-si (KR); Sang-Hun Jang, Yongin-si (KR); Seung-Hyun Son, Hwaseong-si (KR); Gi-Young Kim, Chungju-si (KR); Hyoung-Bin Park, Seongnam-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 41 days.

(21) Appl. No.: 10/986,144

(22) Filed: Nov. 12, 2004

(65) Prior Publication Data

US 2005/0110409 A1 May 26, 2005

(30) Foreign Application Priority Data

Nov. 24, 2003 (KR) ..... 10-2003-0083617

(51) Int. Cl.
*H01J 17/49* (2006.01)

(52) U.S. Cl. ..... 313/587; 313/582; 313/583; 313/584; 313/585; 315/169.1; 315/169.4

(58) Field of Classification Search ..... 313/582–587, 313/485, 486, 292; 315/169.1, 169.4; 345/60, 345/71, 41, 37
See application file for complete search history.

(56) References Cited

U.S. PATENT DOCUMENTS

| | | | | |
|---|---|---|---|---|
| 4,638,218 | A | 1/1987 | Shinoda | |
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,744,909 | A * | 4/1998 | Amano | 313/585 |

(Continued)

FOREIGN PATENT DOCUMENTS

| | | |
|---|---|---|
| JP | 02-148645 | 6/1990 |
| JP | 2845183 | 10/1998 |

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Joseph Williams
*Assistant Examiner*—Hana Asmat Sanei
(74) *Attorney, Agent, or Firm*—Robert E. Bushnell, Esq.

(57) ABSTRACT

A design for a plasma display panel (PDP). The novel PDP has two separate layers of fluorescent material. One layer of fluorescent material can generate long wavelength from VUV rays and the other fluorescent layer can convert either of VUV or long wavelength ultraviolet rays into visible rays. Such a PDP improves the luminance efficiency by more efficiently using the UV and VUV rays generated during plasma discharge.

21 Claims, 4 Drawing Sheets

U.S. PATENT DOCUMENTS

| | | | | |
|---|---|---|---|---|
| 5,786,794 | A | 7/1998 | Kishi et al. | |
| 5,952,782 | A | 9/1999 | Nanto et al. | |
| 5,959,403 | A | 9/1999 | Lee | |
| RE37,444 | E | 11/2001 | Kanazawa | |
| 6,630,916 | B1 | 10/2003 | Shinoda | |
| 6,707,436 | B1 | 3/2004 | Setoguchi et al. | |
| 2003/0098643 | A1* | 5/2003 | Park et al. | 313/495 |

FOREIGN PATENT DOCUMENTS

| | | | |
|---|---|---|---|
| JP | 2917279 | | 4/1999 |
| JP | 11-067103 | * | 9/1999 |
| JP | 2001-043804 | | 2/2001 |
| JP | 2001-325888 | | 11/2001 |
| JP | 2002080843 A | * | 3/2002 |

* cited by examiner

PLASMA DISPLAY PANEL WITH TWO OPPOSING FLUORESCENT LAYERS IN VUV & UV DISCHARGE SPACE

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 24 Nov. 2003 and there duly assigned Ser. No. 2003-83617.

BACKGROUND OF THE INVENTION

1. Field of the Invention

The present invention relates to a plasma display panel (PDP), and more particularly, to a design for a PDP resulting in improved luminous efficiency.

2. Description of the Related Art

A PDP generates visible rays of a predetermined wavelength from a fluorescent material energized by ultraviolet rays in a plasma discharge. The amount of visible rays depends on a discharge distance. However, there is a limit as to the size of the discharge distance within a small discharge area of a PDP. In order to display images of high luminance, a large amount of ultraviolet rays are required and it is necessary to efficiently activate the fluorescent material by using the ultraviolet rays. However, a significant amount of the generated ultraviolet rays never reach and activate the fluorescent material leading to waste.

Turning now to the figures, FIG. 1 is a sectional view illustrating a surface discharge type PDP according to the prior art. The PDP of FIG. 1 is similar to FIG. 2 of U.S. Pat. No. 5,959,403 to Lee. The PDP illustrated in FIG. 1 can also be derived from U.S. Pat. No. 4,638,218 to Shinoda et al. Referring to FIG. 1, predetermined barrier walls 9 are located between a front plate 1 and a rear plate 2. First and second sustain electrodes 3*a* and 3*b* are formed on the surface of the front plate 1 facing the rear plate 2, and a first dielectric layer 4*a* and a protection layer 5 are formed over the first and second sustain electrodes 3*a* and 3*b*. An address electrode 6 is formed on the surface of the rear plate 2 facing the front plate 1 to correspond to the first and second sustain electrodes 3*a* and 3*b*, and a second dielectric layer 4*b* is formed over the address electrode 6. A fluorescent layer 7 is formed on the sidewalls of the barrier walls 9 and on the surface of the rear plate 2 facing the front plate 1.

A discharge method for the surface discharge type PDP is disclosed in U.S. Pat. No. 4,638,218 to Shinoda et al. In the surface discharge type PDP, an initial discharge is induced by one sustain electrode and one address electrode, and then the initial discharge is maintained by the sustain electrodes. The ultraviolet rays generated in a discharge area 8 are absorbed in the fluorescent layer 7 to activate the fluorescent layer 7. The ultraviolet rays produced in discharge area 8 are radiated in every direction and thus some rays never reach the fluorescent layer, producing wasted energy. Also, vacuum ultraviolet rays (VUV) are also produced in the discharge area 8. These VUV rays have a shorter wavelength than ultraviolet rays. However, the fluorescent layer 7 may not be able to convert the VUV rays into visible light, further producing waste. In other words, a large amount of radiation generated in the discharge area is not converted into visible light. Thus, in order to improve the luminance efficiency, a design for a PDP that converts VUV rays into visible light and converts more of the generated ultraviolet rays into visible light is needed.

SUMMARY OF THE INVENTION

It is therefore an object of the present invention to provide for an improved design for a plasma display panel.

It is also an object to provide a design for a plasma display panel that improves on the luminance efficiency.

It is further an object of the present invention to provide a plasma display where shorter wavelength VUV rays can also be converted to visible images.

These and other objects can be achieved by a PDP that more efficiently converts ultraviolet rays generated from a plasma into visible images of high luminance. According to an aspect of the present invention, there is provided a PDP that includes a container having a gas discharge area and a discharge generating unit generating a discharge in the discharge area, the discharge area includes a first fluorescent layer converting both ultraviolet rays and shorter wavelength vacuum ultraviolet rays (VUV) into visible rays, and a second fluorescent layer converting VUV rays into longer wavelength ultraviolet rays.

According to another aspect of the present invention, there is provided a PDP having a front plate and a rear plate forming a discharge area, barrier walls arranged between the front plate and the rear plate with a predetermined distance therebetween and having a predetermined height, a first fluorescent layer arranged at one side of the discharge area converting VUV and ultraviolet rays into visible rays, and a second fluorescent layer arranged at the other side of the discharge area that converts VUV rays into longer wavelength ultraviolet rays.

The first and second fluorescent layers are formed so that the visible light is emitted in a direction normal to the layers. The first fluorescent layer may be formed on a surface of the front plate that faces the rear plate and the second fluorescent layer may be formed on a surface of the rear plate that faces the front plate. Sustain electrodes may be formed on the inner walls of the barrier walls to face each other. Address electrodes may be formed on the surface of the rear plate that faces the front plate, the address electrodes thus being between the barrier walls.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 2:
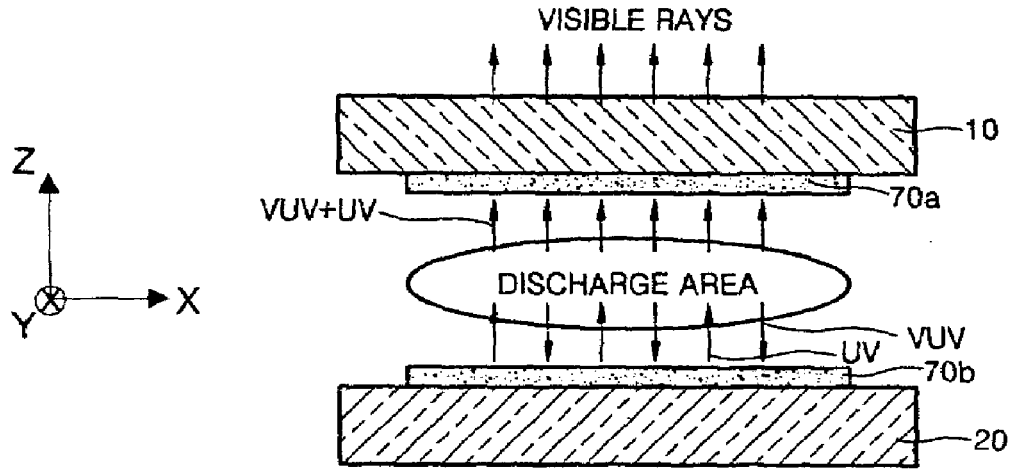
FIG. 2 is a sectional view a PDP according to the present invention illustrating the locations of the two fluorescent layer.

Turning now to FIG. 2, FIG. 2 is a sectional view for explaining a method of generating visible rays by using ultraviolet rays including vacuum ultraviolet rays (VUV) that are generated in a discharge area according to the present invention. Referring to FIG. 2, a front plate 10 and a rear plate 20 are arranged at both sides of a gas plasma discharge area, and a first fluorescent layer 70*a* is formed on the surface of the front plate 10 facing the rear plate 20 and a second fluorescent layer 70*b* is formed on the surface of the rear plate 20 facing the front plate 10.

The first fluorescent layer 70*a* is formed of a fluorescent material is able to convert both the ultraviolet rays and the shorter wavelength VUV rays into visible light. The second fluorescent layer 70*b* is formed of a fluorescent material that converts VUV into ultraviolet rays having a longer wavelength than VUV. The ultraviolet rays and the VUV generated in the discharge area progress in every direction, and the VUV and the ultraviolet rays arriving at the first fluorescent layer 70*a* activate the first fluorescent layer 70*a* to generate visible rays. The VUV rays arriving at the second fluorescent layer 70*b* activate the second fluorescent layer 70*b* to generate the ultraviolet rays of the longer wavelength. The ultraviolet rays generated from the second fluorescent layer 70*b* progress to the first fluorescent layer 70*a* to activate the first fluorescent layer 70*a*, resulting in the generation of the visible rays. Thus, by designing the two fluorescent layers as in FIG. 2, the VUV and more of the generated ultraviolet light can be converted into visible light resulting in a higher luminance.

Figure 3:
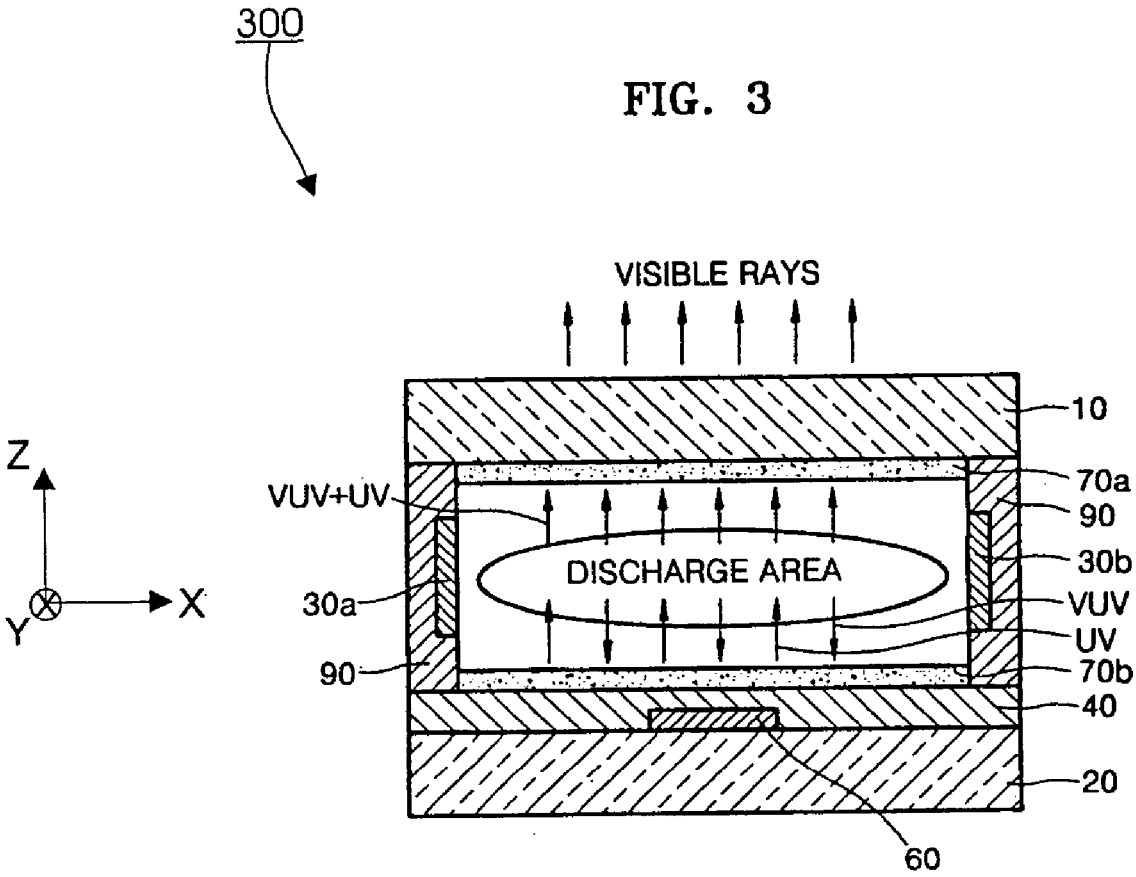
FIG. 3 is a sectional view illustrating a DC PDP according to a first embodiment of the present invention.

Turning now to FIG. 3, FIG. 3 illustrates a sectional view of PDP 300 according to a first embodiment of the present invention. PDP 300 of FIG. 3 is a DC type PDP. Referring to FIG. 3, the discharge area may extend to the planar directions of first and second fluorescent layers 70*a* and 70*b*, thus sustain electrodes 30*a* and 30*b* are arranged on barrier walls 90 between front plate 10 and rear plate 20. Sustain electrodes 30*a* and 30*b* face each other. The sustain electrodes 30*a* and 30*b* form a surface discharge type (or coplanar type) instead of a facing discharge type (or opposed discharge type). A surface discharge type PDP is characterized in that a pair of sustain electrodes are formed on a substrate, typically a front substrate. Meanwhile, a facing discharge type PDP is characterized in that one electrode is formed on a front substrate and the other is formed on the rear substrate so that the discharge occurs between electrodes located on opposite plates.

According to a first embodiment of the present invention, the discharge area extends between the front plate 10 and the rear plate 20 in the z direction and between the sustain electrodes 30*a* and 30*b* in the x direction. Such a design improves discharge efficiency and results in a large amount of ultraviolet rays being generated. An address electrode 60 is formed on the surface of the rear plate 20 facing the front plate 10, a dielectric layer 40 covers the address electrode 60, and the second fluorescent layer 70*b* is formed on the dielectric layer 40. In the DC PDP 300 of FIG. 3, a material for protecting the sustain electrodes 30*a* and 30*b* from ion impacts may be coated on the sustain electrodes 30*a* and 30*b*. Thus, an address discharge occurs in any one of areas between the address electrode 60 and the sustain electrodes 30*a* and 30*b*, and a DC plasma discharge is maintained between the sustain electrodes 30*a* and 30*b*.

Figure 4:
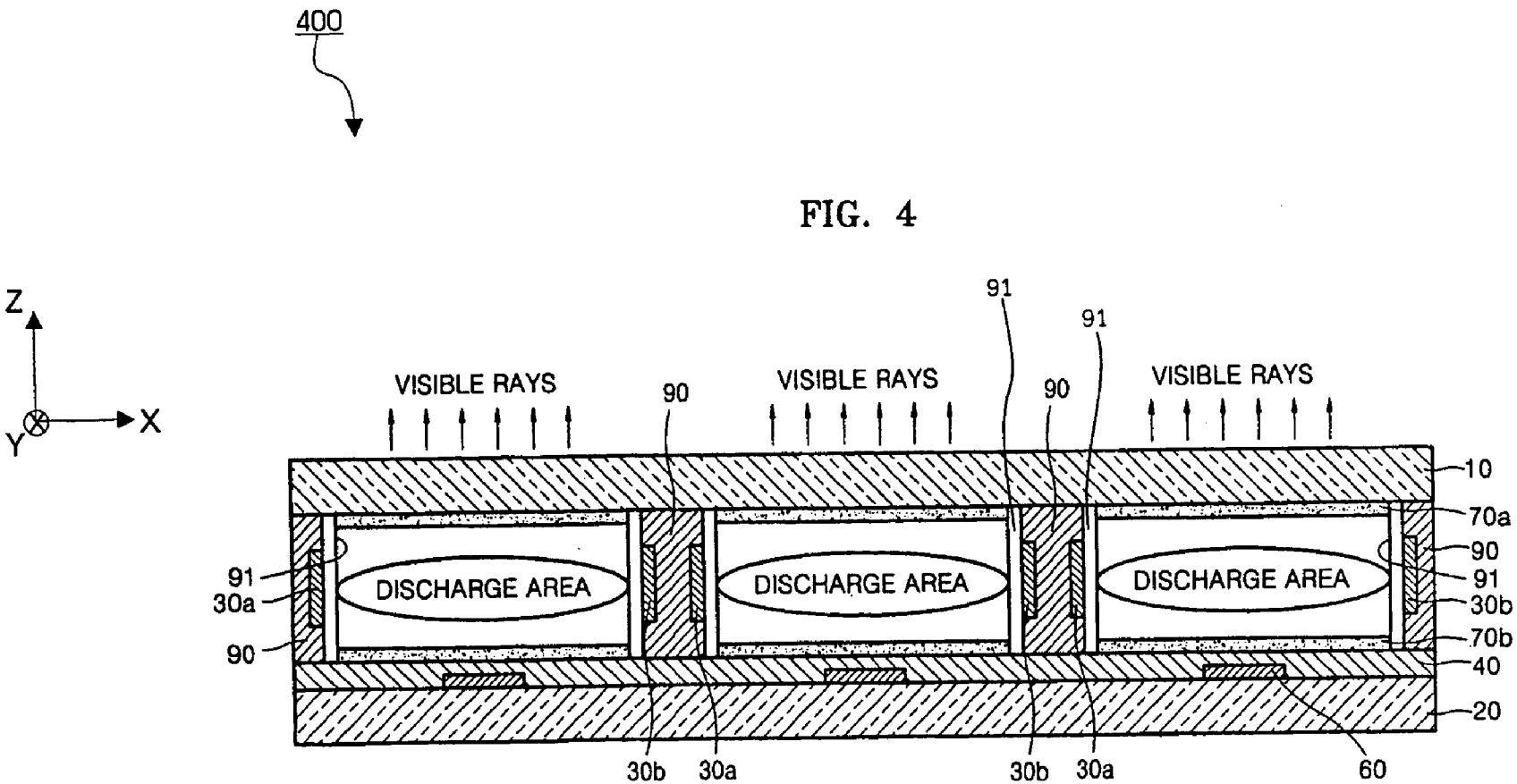
FIG. 4 is a sectional view illustrating an AC PDP according to a second embodiment of the present invention.

Turning now to FIG. 4, FIG. 4 illustrates a PDP 400 according to a second embodiment of the present invention. In FIG. 4, the PDP 400 is an AC type PDP. Referring to FIG. 4, a front plate 10 and a rear plate 20 are separated by barrier walls 90 having a predetermined height, and a discharge area is formed between the front plate 10 and the rear plate 20. Sustain electrodes 30*a* and 30*b* are formed on the inner walls of the barrier walls 90. Dielectric layers 91 are formed over the sustain electrodes 30*a* and 30*b* to help sustain an AC discharge between the sustain electrodes 30*a* and 30*b*. An address electrode 60 is arranged on the surface (+z surface) of the rear plate 20 facing the front plate 10, and a dielectric layer 40 covers on the address electrode 60. A second fluorescent layer 70*b*, that converts VUV to longer wavelength ultraviolet light, is formed on the dielectric layer 40. A first fluorescent layer 70*a*, which generates visible rays from the ultraviolet rays of any wavelength (i.e., long wavelength ultraviolet and the shorter VUV), is formed on the surface of the front plate 10 facing the rear plate 20. An address discharge occurs in any one of areas between the address electrode 60 and the sustain electrodes 30*a* and 30*b* for a short time, and an AC plasma discharge is maintained between the sustain electrodes 30*a* and 30*b*. In the PDPs illustrated in FIGS. 3 and 4, a protection layer, such as an MgO layer or $MgF_2$ layer, may also be formed on the surface of the first fluorescent layer 70*a* to protect the first fluorescent layer 70*a* from ion impact in the first and second embodiments of the present invention.

Figure 5:
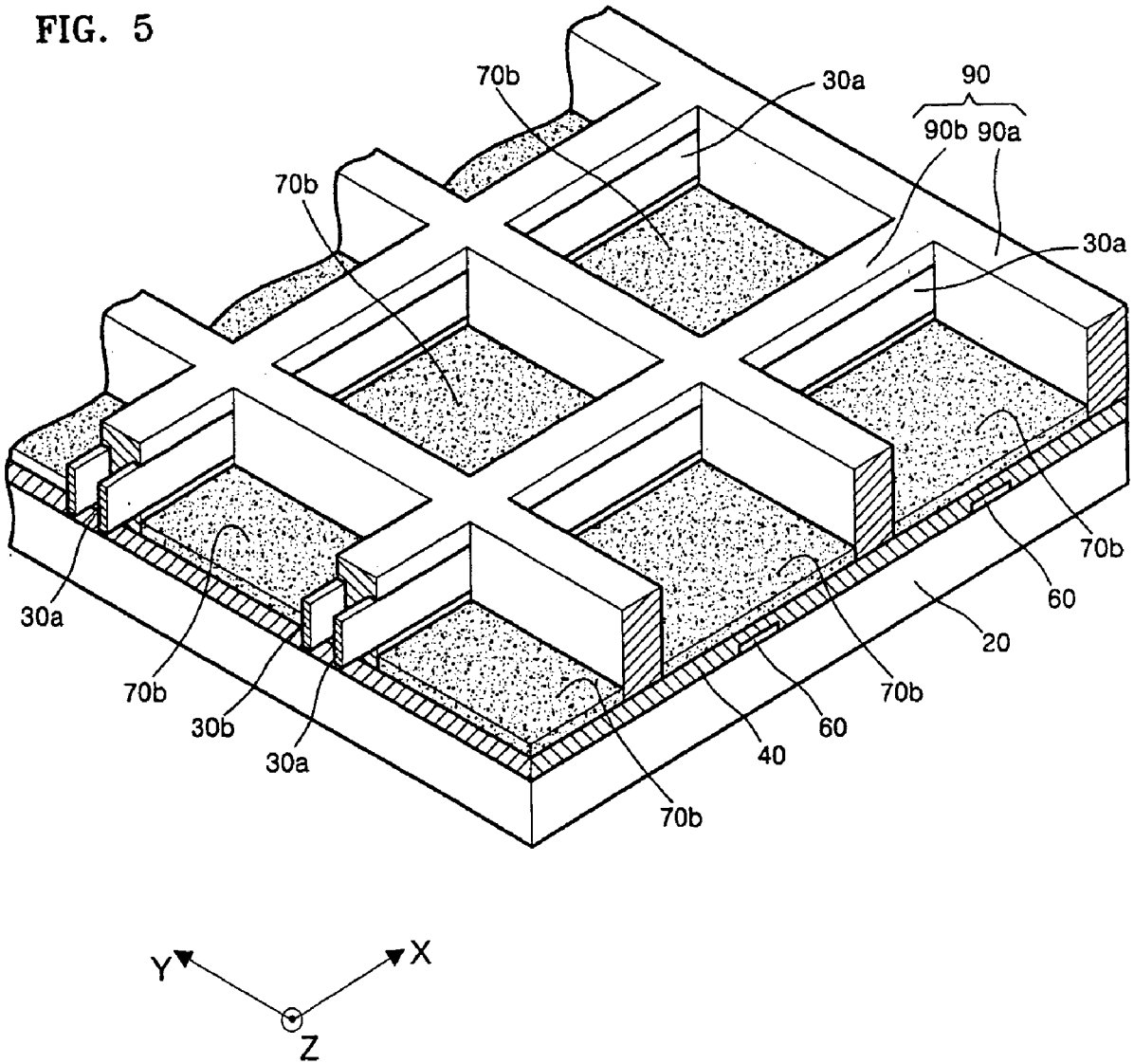
FIG. 5 is a perspective view illustrating a rear plate of a PDP according to a third embodiment of the present invention.

Turning now to FIG. 5, FIG. 5 is a perspective view illustrating a rear plate 20 on which barrier walls 90 are formed in a lattice type. In the first and second embodiments of the present invention, the barrier walls are formed in a stripe shape. In the present invention, the barrier ribs may instead be formed in a lattice or matrix formation instead of the stripe formation. The lattice formation serves to prevent crosstalk between pixels. The barrier walls 90 include first portions 90*a* running in the y direction parallel to the address electrodes 60 and having sustain electrodes 30*a* and 30*b* formed thereon. The second portions 90*b* are preferably perpendicular to the first portions 90*a* and run in the x direction and define unit pixel areas together with the first portions 90*b*. It is to be appreciated that the barrier walls need not be perpendicular to each other as other configurations, such a honey comb are not outside the scope of the present invention.

Unlike FIGS. 3 and 4, the PDP illustrated in FIG. 5 shows the sustain electrodes 30*a* and 30*b* as being perpendicular to the address electrodes 60, in order to emphasize that the principles of the present invention can apply to a large range of PDP structures. In FIGS. 5, second fluorescent layers 70*b* are formed on portions of the rear plate 20 where the barrier walls 90 are not formed, and the address electrodes 60 and an insulating layer for protecting the address electrodes 60 are formed under the second fluorescent layers 70*b*. The sustain electrodes 30*a* and 30*b* are illustrated in FIG. 5 as not being covered by dielectric layer, however the present invention can use the matrix or lattice shaped barrier ribs where a dielectric layer covers the sustain electrodes 30*a* and 30*b* as in FIG. 4.

Figure 1:
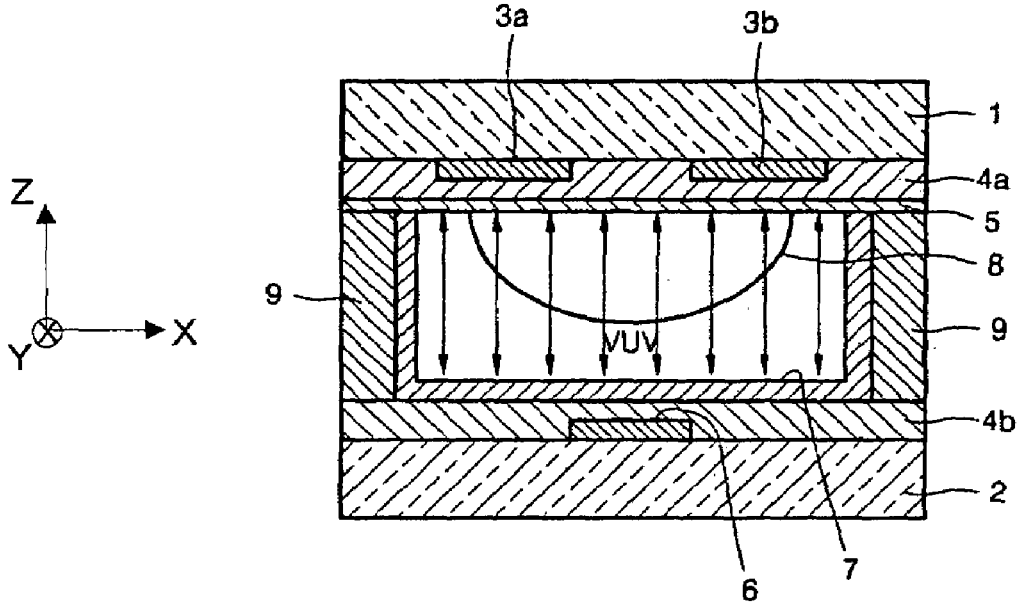
FIG. 1 (PRIOR ART)
FIG. 1 is a sectional view illustrating the structure of a prior art plasma display panel (PDP)

It is to be appreciated that the present invention is not limited to the exact configurations of FIGS. 1 through 5 but other configurations and combinations of configurations are also within the scope of the present invention. For example, the sustain electrodes and the address electrodes in FIGS. 1, 3, and 4 are illustrated as being parallel to each other running in the y direction however the present invention is in no way limited in this way. Also in the embodiments of the present invention, instead of being formed on the barrier walls, the sustain electrodes can be formed on a front plate as in FIG. 1.

As described above, a PDP according to the present invention includes one fluorescent layer that converts both long wave ultraviolet rays and VUV rays into visible rays and another fluorescent layer that converts VUV rays into longer wavelength ultraviolet rays. Such a design results in a more efficient use of the ultraviolet rays and VUV generated from a plasma discharge. Accordingly, the luminance of the PDP may be improved.

While the present invention has been particularly shown and described with reference to exemplary embodiments thereof, it will be understood by those of ordinary skill in the art that various changes in form and details maybe made therein without departing from the spirit and scope of the present invention as defined by the following claims.

What is claimed is:

1. A plasma display panel (PDP), comprising:

a container having a discharge area; and a discharge generating unit adapted to generate a discharge in the discharge area, the discharge area comprises a first fluorescent layer generating visible rays from both ultraviolet rays and vacuum ultraviolet rays (VUV), and a second fluorescent layer generating ultraviolet rays from VUV, the second fluorescent layer being separated from the first fluorescent layer by a distance.

2. The PDP of claim 1, the first fluorescent layer being arranged so that the generated visible rays travel in a direction normal to the first fluorescent layer.

3. The PDP of claim 1, the first fluorescent layer being parallel to the second fluorescent layer, rays generated from the first and the second fluorescent layers travel in a direction normal to the first and the second fluorescent layers.

4. A plasma display panel (PDP), comprising:

a container having a discharge area;

a discharge generating unit adapted to generate a discharge in the discharge area, the discharge area comprises a first fluorescent layer generating visible rays from both ultraviolet rays and vacuum ultraviolet rays (VUV), and a second fluorescent layer generating ultraviolet rays from VUV; and sustain electrodes adapted to form a sustain discharge and arranged between the first fluorescent layer and the second fluorescent layer. the first fluorescent layer being parallel to the second fluorescent layer, rays generated from the first and the second fluorescent layers travel in a direction normal to the first and the second fluorescent layers.

5. The PDP of claim 4, the container comprising a plurality of barrier walls, the sustain electrodes being arranged on the barrier walls.

6. The PDP of claim 5, wherein surfaces of the sustain electrodes face the surfaces of the other adjacent sustain electrodes.

7. A PDP, comprising:

a front plate facing a rear plate with a discharge area therebetween;

barrier walls arranged between the front plate and the rear plate with a predetermined distance and having a predetermined height;

a first fluorescent layer arranged at one side of the discharge area and adapted to generate visible rays from both VUV and from ultraviolet rays; and a second fluorescent layer arranged at another side of the discharge area adapted to generate ultraviolet rays from VUV.

8. The PDP of claim 7, the first fluorescent layer being arranged on a surface of the front plate and facing the rear plate, the second fluorescent layer being arranged on a surface of the rear plate and facing the front plate.

9. The PDP of claim 7, further comprising sustain electrodes arranged on inner walls of the barrier walls and facing each other.

10. The PDP of claim 9, further comprising address electrodes arranged on a surface of the rear plate and facing the front plate, the address electrodes being arranged between the barrier walls.

11. The PDP of claim 10, the sustain electrodes and the inner walls of the barrier walls being covered by a dielectric material layer.

12. The PDP of claim 7, further comprising address electrodes arranged on a surface of the rear plate and facing the front plate, the address electrodes being arranged between the barrier walls.

13. The PDP of claim 12, further comprising sustain electrodes arranged on inner walls of the barrier walls and facing each other, the sustain electrodes and the inner walls of the barrier walls being covered by a dielectric material layer.

14. The PDP of claim 7, the second fluorescent layer being separated from the first fluorescent layer by a distance.

15. A plasma display panel, comprising:

a front plate facing a rear plate with a discharge area in between;

barrier walls arranged between the front plate and the rear plate separating the front plate from the rear plate;

a first fluorescent layer arranged on the front plate, the first fluorescent layer adapted to produce visible rays from both VUV and from longer wavelength ultraviolet rays; and a second fluorescent layer arranged on the rear plate, the second fluorescent layer adapted to produce long wavelength ultraviolet rays from a shorter wavelength VUV rays.

16. The plasma display panel of claim 15, further comprising address electrodes arranged on the rear plate underneath the second fluorescent layer and sustain electrodes arranged on the front plate underneath the first fluorescent layer.

17. The plasma display panel of claim 16, the address electrodes and the sustain electrodes each being covered by dielectric material.

18. The plasma display panel of claim 15, further comprising address electrodes arranged on the rear plate underneath the second fluorescent layer and sustain electrodes on the barrier walls between the front plate and the rear plate.

19. The plasma display panel of claim 18, the address electrodes and the sustain electrodes each being covered by dielectric material.

20. The plasma display panel of claim 15, the barrier walls being in a stripe pattern.

21. The plasma display panel of claim 15, the barrier ribs being in a lattice pattern.

* * * * *